US008539806B2

(12) United States Patent
Hoehne et al.

(10) Patent No.: US 8,539,806 B2
(45) Date of Patent: Sep. 24, 2013

(54) ROLL FORMING METHOD FOR PRODUCING LONGITUDINALLY TOOTHED PROFILED BODIES IN POT-SHAPED CYLINDRICAL WORKPIECES

(75) Inventors: Peter Hoehne, Friedrichsthal (DE); Martin Meyer, Heusweiler (DE); Ralf Fischer, Waschenbeuren (DE); Andreas Essl, Donzdorf (DE)

(73) Assignees: ZF Friedrichshafen AG, Friedrichshafen (DE); Allgaier Werke GmbH, Uhingen (DE)

( * ) Notice: Subject to any disclaimer, the term of this patent is extended or adjusted under 35 U.S.C. 154(b) by 297 days.

(21) Appl. No.: 12/995,245

(22) PCT Filed: May 27, 2009

(86) PCT No.: PCT/EP2009/056453

§ 371 (c)(1),
(2), (4) Date: Nov. 30, 2010

(87) PCT Pub. No.: WO2009/150053

PCT Pub. Date: Dec. 17, 2009

(65) Prior Publication Data

US 2011/0083485 A1 Apr. 14, 2011

(30) Foreign Application Priority Data

Jun. 9, 2008 (DE) ..... 10 2008 002 297

(51) Int. Cl.
*B21D 15/00* (2006.01)

(52) U.S. Cl.
USPC ..... 72/102; 72/95; 72/231

(58) Field of Classification Search
USPC ..... 72/75, 77, 82, 83, 84, 95, 96, 100, 72/102, 107, 110, 231, 379.4
See application file for complete search history.

(56) References Cited

U.S. PATENT DOCUMENTS

| | | | | |
|---|---|---|---|---|
| 496,601 | A * | 5/1893 | Edge | 72/68 |
| 629,245 | A * | 7/1899 | Frank | 72/75 |
| 2,565,623 | A * | 8/1951 | Parker | 216/53 |
| 2,715,846 | A * | 8/1955 | Grob et al. | 72/100 |
| 2,937,547 | A * | 5/1960 | Moeltzner | 72/95 |
| 3,729,970 | A | 5/1973 | Propach et al. | |
| 5,471,858 | A | 12/1995 | Deriaz | |
| 5,709,118 | A | 1/1998 | Ohkubo | |
| 6,769,281 | B2 * | 8/2004 | Irie et al. | 72/121 |
| 7,540,179 | B2 | 6/2009 | Schlayer et al. | |
| 2009/0126440 | A1 | 5/2009 | Ziesel et al. | |

FOREIGN PATENT DOCUMENTS

| | | | |
|---|---|---|---|
| DE | 2 017 709 | | 11/1971 |
| DE | 24 39 957 | A1 | 3/1976 |
| DE | 28 29 041 | A1 | 1/1980 |
| DE | 195 06 391 | A1 | 9/1996 |
| DE | 196 23 453 | A1 | 12/1996 |
| DE | 10 2006 025 034 | A1 | 11/2007 |

(Continued)

*Primary Examiner* — Edward Tolan
(74) *Attorney, Agent, or Firm* — Davis & Bujold, PLLC

(57) ABSTRACT

A roll-forming process for producing longitudinally toothed profiled bodies in a pot-shaped cylindrical workpiece in which, during a first rolling process (A), the pot-shaped cylindrical workpiece (1) is moved through a first rolling stage with a bottom (3) of the workpiece being rolled first. During at least one further rolling process (B, C), the workpiece (1) passes through at least one further rolling stage with an open end of the workpiece being rolled first.

6 Claims, 1 Drawing Sheet

(56) References Cited

FOREIGN PATENT DOCUMENTS

| | | | | |
|---|---|---|---|---|
| EP | 0 558 815 | A1 | | 9/1993 |
| EP | 0 728 540 | A2 | | 8/1996 |
| JP | 61-135405 | | * | 6/1986 |
| WO | 2006/066525 | A1 | | 6/2006 |

* cited by examiner

FIG. 1A1
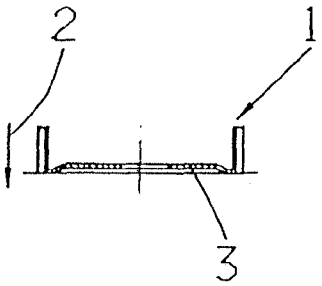
FIG. 2A1
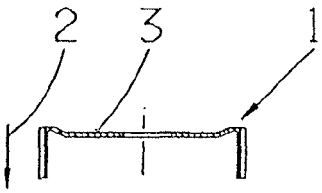
FIG. 3A1
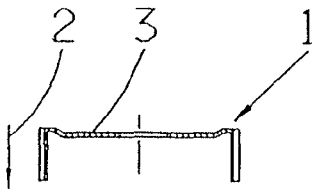
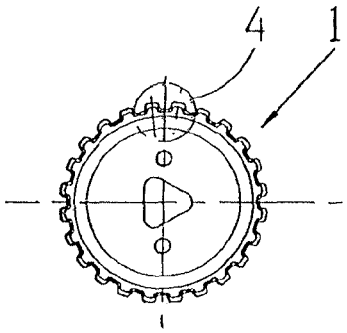
FIG. 1A2
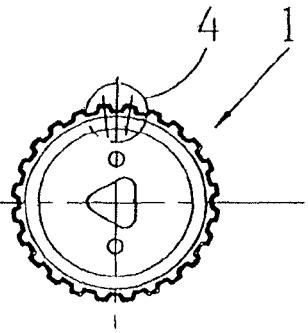
FIG. 2A2
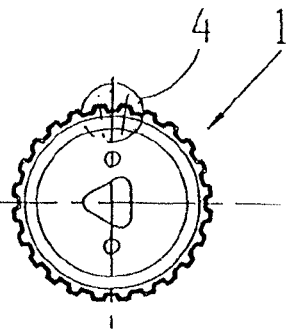
FIG. 3A2
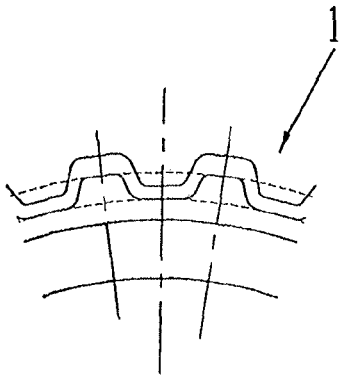
FIG. 1A3
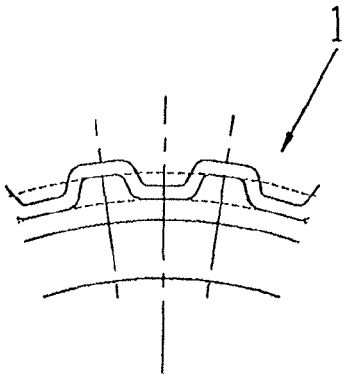
FIG. 2A3
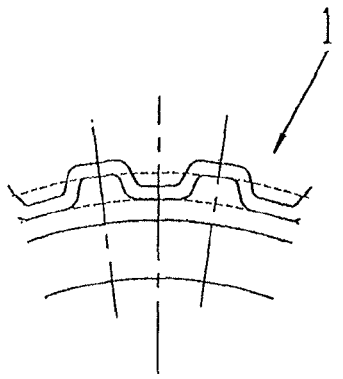
FIG. 3A3

ROLL FORMING METHOD FOR PRODUCING LONGITUDINALLY TOOTHED PROFILED BODIES IN POT-SHAPED CYLINDRICAL WORKPIECES

This application is a National Stage completion of PCT/EP2009/056453 filed May 27, 2009, which claims priority from German patent application serial no. 10 2008 002 297.7 filed Jun. 9, 2008.

FIELD OF THE INVENTION

The present invention relates to a roll-forming process for producing longitudinally toothed profiled bodies in cylindrical workpieces.

BACKGROUND OF THE INVENTION

In the production of profiled bodies such as disk carriers of shift elements or similar workpieces having a cylindrical basic structure, the accuracy and surface quality attainable are particularly important.

DE 20 17 709 A1 by the present applicant describes a method for producing profiled bodies, in which a rolling tool is used to produce the workpiece from a blank with a smooth outer contour by means of a press, such that each stroke of the press shapes a workpiece from a blank. In this case it is provided that during each stroke of the press a rolling process is carried out, in which, along the periphery of the workpiece being processed, profile rolls arranged regularly and at a uniform angle relative to one another press the desired outer profile into the external surface of the workpiece. The grooves produced by the respective profile rolls in this process are all the same as one another, so an outer contour with no discontinuities can be produced.

Disadvantageously, in this known method the rotation and thus rolling of the profile rolls is produced only by the forces, acting during the deformation, between a workpiece and a profile roll, whereby an indeterminable slip of the profile roll relative to the workpiece takes place, which in the case of a profile with an irregular shape in the longitudinal direction results in dimensional inaccuracies. Moreover, as the profile roll is moved into the material, a zone is produced, in which the tooth flank is not fully formed.

DE 195 06 391 A1 describes a method for producing profiled bodies, in which the profile rolls are driven in such a manner that the circumferential speed in the deformation zone matches the speed of the workpiece, so that slip between the profile rolls and the workpieces is largely avoided; disadvantageously, an elaborate and expensive structure is needed to carry out the process.

Usually, the roll-forming process begins in a gang press on the pot bottom of pot-shaped workpieces, so that by virtue of the process material flows from the crown of the teeth into their flanks and along the teeth, whereby the shaping of the teeth in the area of the pot bottom is deficient.

To solve this problem WO 2006/066525 A1 proposes a method for producing longitudinal grooves in cylindrical workpieces using a roll-forming process with an upstream pre-forming stage, such that by means of the pre-forming process accumulations of material can be produced in the corner areas of the blank. In this way material is aggregated at the positions in the blank where the profile rolls press into the material during the actual roll-forming, so that optimized profile bearing ratios and sheet thicknesses for the roll-forming process can be achieved. In this case swaging and/or upsetting processes can be carried out for the pre-forming.

However, after the end of the roll-forming process bulging or relaxation can result in dimensional problems at the teeth.

Furthermore, from EP 0728 540 A1 a tool for sheet deformation is known, in particular for a press, in order to provide a tooth-shaped or undulating profile in a shaped sheet component. The known tool has a lower tool portion and an upper tool portion which co-operate to deform the shaped component, such that deformation takes place in one working step and to produce the tooth-shaped or undulating profile, shaping rolls are provided, which are arranged on a circular circumference directed toward the shaped component. In this case, to supplement the friction force with the shaped component the shaping rolls are equipped with a drive mechanism which drives them in rotation about their own axes.

From DE 102006025034 A1 a method for producing longitudinal grooves in cylindrical workpieces is known, in which a profile at the circumference of the workpiece is produced by means of concentrically arranged profile segment disks. In this case the profile segment disks are moved by a drive at all times during the deformation process; the drive is independent of the rolling motion of the profile segment disks on the workpiece.

In the mass production of toothed disk carriers from a drawn sheet cylinder, according to the prior art the workpiece is moved with its closed face, i.e. the bottom of the cylinder, through the rolling stages so that the freely rotating profile rolls press the material onto the rolling ram to give it the desired tooth shape. To obtain the final profile at least two rolling stages are needed, since otherwise the material cannot withstand this deformation, and cracks; as a rule, such a roll-forming process has three rolling stages.

This method has the disadvantage that at the transition from the bottom to the tooth crown a lot of material flows in the direction of the open end, which means that at the tooth crown there is some loss of material, as is usual in deformation processes of this type.

Accordingly, the useful profile, i.e. the finished tooth shape, begins not in the area of the bottom but a few millimeters above the bottom, and as a result the disk carrier has to be made correspondingly longer in order to be able to carry the required number of disks with positive interlock. This in turn results in an undesired increase of the structural length and the weight of the transmission.

SUMMARY OF THE INVENTION

The purpose of the present invention is to indicate a roll-forming process for producing longitudinally toothed profiled bodies in pot-shaped cylindrical workpieces, by carrying out which the useful profile of the longitudinal teeth is maximized. In particular the tooth formation in the area of the bottom of the workpiece should be optimized and the disadvantageous material retraction at the tooth crown described should be substantially reduced.

Accordingly a roll-forming process is proposed in which, as in the prior art, in a first rolling stage the pot-shaped cylindrical workpiece moves bottom-first through a rolling process in such manner that, preferably, in this first rolling stage the tooth crowns are over-rolled to a specified, slight extent, whereby the workpiece remains approximately cylindrical.

Thanks to the over-rolling stage, bulging of the workpiece while the process is being carried out is avoided.

Thereafter, the pot-shaped cylindrical workpiece is moved with its open end first through at least one further rolling stage; preferably, the workpiece, as a rule, in the form of a pot made from sheet passes through two further rolling stages. By virtue of this process the material flows toward the bottom and there shapes the teeth optimally. Thanks to this procedure, for example a disk carrier has teeth optimally shaped in the bottom area, in which the disks can be held.

Thanks to the concept according to the invention, the bearing profile begins at the bottom of the pot-shaped cylindrical sheet component, although the same number of rolling stages are needed as in the prior art.

BRIEF DESCRIPTION OF THE DRAWINGS

Below, the invention is explained in more detail with reference to an example illustrated in the attached figures in which:

FIG. 1A1-1A3 illustrate a direction of travel of a component in a first rolling process and sectional views of the component after the first rolling process;

FIG. 2A1-2A3 illustrate a direction of travel of the component in a second rolling process and sectional views of the component after the second rolling process; and FIG. 3A1-3A3 illustrate a direction of travel of the component in a third rolling process and sectional views of the component after the third rolling process.

DETAILED DESCRIPTION OF THE PREFERRED EMBODIMENTS

FIGS. 1A1, 2A1, 3A1 show the arrangement of a pot-shaped cylindrical sheet component 1 for each rolling process A, B, C, the arrow 2 indicating the direction in which the sheet component 1 moves through the corresponding rolling stage. The FIGS. 1A2, 1A3, 2A2, 2A3, 3A2, 3A3 show a section perpendicular to the longitudinal axis of the sheet component 1 after the respective rolling stage or rolling process, and a detailed view of the area identified by the circle 4 after each rolling stage is shown in the lower part of the figure. Before the beginning of the roll-forming process the sheet is processed as in the prior art by drawing, stretching and/or punching.

According to the invention and referring to FIG. 1A1, at the beginning of the roll-forming process, in rolling stage A, the sheet component 1 is moved through the rolling stage with its bottom 3 first in such manner that, as a further development of the invention, in this first rolling process the tooth crown is over-rolled to a specified extent, whereby the sheet component 1 remains approximately cylindrical.

In rolling stage B the sheet component 1 is then passed, open end first, through a second rolling stage as shown in FIG. 1A2. This process causes the material to flow toward the bottom of the sheet component 1, where it forms optimally shaped teeth.

In a subsequent step, in a third rolling process C the sheet component 1 is again passed open end first through a rolling stage, as shown in FIG. 1A3, in order to obtain optimum shaping of the sheet component.

The invention claimed is:

1. A roll-forming process for producing longitudinally toothed profiled bodies in a pot-shaped cylindrical workpiece, the process comprising the steps:

moving substantially an entire axial length of the pot-shaped cylindrical workpiece (1), during a first rolling process (A), axially through a first rolling stage such that a bottom (3) of the workpiece being inserted and rolled first, and a location on a cylindrical wall of the workpiece is roll-formed a first time; and passing substantially the entire axial length of the workpiece (1), during at least one further rolling process (B, C) following the first rolling process (A), axially through at least one further rolling stage with an open end of the workpiece being inserted and rolled first, and the location on the cylindrical wall of the workpiece is roll-formed a second time.

2. The roll-forming process according to claim 1, further comprising the step of over-rolling tooth crowns, during the first rolling process (A), to a specified extent in order to avoid bulging of the workpiece during the roll-forming process.

3. A roll-forming process for producing a longitudinally toothed profiled bodies in a cylindrical workpiece comprising a cylindrical wall with one axial end having a bottom surface and an opposite axial end being open, the cylindrical wall comprising a plurality of axially extending teeth that are regularly spaced about a circumference of the cylindrical wall, the process comprising the steps of:

conducting the workpiece axially through a first rolling stage with the bottom surface passing and being rolled first so as to over-roll tooth crowns to a specified extent to avoid bulging of the workpiece, roll-forming a location on the cylindrical wall a first time;

conducting the workpiece axially through a second rolling stage with the open end of the workpiece passing and being rolled first so as to direct material of the cylindrical wall to flow toward the bottom surface so as to form shaped teeth; and conducting the workpiece axially through a third rolling stage with the open end of the workpiece passing and being rolled first so as to shape the workpiece, and roll-forming a location on the cylindrical wall a third time.

4. The roll-forming process according to claim 3, further comprising the step of the workpiece being approximately cylindrical after the first rolling stage.

5. The roll-forming process according to claim 3, further comprising the step of, during each rolling stage, passing the entire axial length of the workpiece completely through the rolling stage.

6. A roll-forming process for producing longitudinally toothed profiled bodies in a pot-shaped cylindrical workpiece, the process comprising the steps:

moving the pot-shaped cylindrical workpiece (1), during a first rolling process (A), axially through a first rolling stage such that the bottom (3) of the workpiece passing through and being rolled first, and a location on a cylindrical wall of the workpiece is roll-formed a first time; and passing the workpiece (1) axially through at least one further rolling stage, during at least one further rolling process (B, C) which follows the first rolling process (A), during which the open end of the workpiece passing through and being rolled first so as to direct material of the cylindrical wall to flow toward the bottom surface, and the location on the cylindrical wall of the workpiece is roll-formed a second time.

* * * * *